US009212813B2

(12) United States Patent
Wang

(10) Patent No.: US 9,212,813 B2
(45) Date of Patent: Dec. 15, 2015

(54) MOISTURE-PROOF SPOTLIGHT

(71) Applicant: Mao-Shen Wang, New Taipei (TW)

(72) Inventor: Mao-Shen Wang, New Taipei (TW)

( * ) Notice: Subject to any disclaimer, the term of this patent is extended or adjusted under 35 U.S.C. 154(b) by 0 days.

(21) Appl. No.: 14/450,818

(22) Filed: Aug. 4, 2014

(65) Prior Publication Data

US 2015/0049494 A1 Feb. 19, 2015

(30) Foreign Application Priority Data

Aug. 16, 2013 (TW) ..... 102215480 U

(51) Int. Cl.

| | |
|---|---|
| ***F21V 19/02*** | (2006.01) |
| ***F21V 31/00*** | (2006.01) |
| ***F21V 15/01*** | (2006.01) |
| ***F21V 21/30*** | (2006.01) |

(52) U.S. Cl.

CPC ..... *F21V 31/00* (2013.01); *F21V 15/01* (2013.01); *F21V 21/30* (2013.01)

(58) Field of Classification Search

CPC ..... F21V 31/00; F21V 15/01; F21V 21/30
USPC ..... 362/372, 368, 371, 375
See application file for complete search history.

(56) References Cited

U.S. PATENT DOCUMENTS

2013/0128493 A1* 5/2013 Osaki et al. ..... 362/84

* cited by examiner

*Primary Examiner* — Vip Patel
(74) *Attorney, Agent, or Firm* — Bacon & Thomas, PLLC

(57) ABSTRACT

A moisture-proof spotlight includes a lamp housing, a support pivotally supporting the lamp housing from below and a lamp assembly pivotally installed inside the lamp housing, wherein the lamp housing contains therein a moisture-proof partition set provided for a vertical driving device and a horizontal driving device to affix thereto and also together installed inside the lamp housing for moisture-proof, thereby the defect of a conventional spotlight due to its horizontal driving device installed in the support tended to be affected by moisture is capably eliminated.

3 Claims, 5 Drawing Sheets

MOISTURE-PROOF SPOTLIGHT

BACKGROUND OF THE INVENTION

1. Field of the Present Invention

The present invention relates to spotlights, and more particularly to a moisture-proof spotlight that is invulnerable to moisture.

2. Description of Related Art

Referring to FIG. 1, a conventional spotlight 90 is a lamp capable of changing its lighting direction vertically and horizontally. The spotlight 90 comprises a lamp housing 91 and a support 92 pivotally supporting the lamp housing 91 from below.

In the lamp housing 91, a partition 94 divides the interior of the lamp housing 91 into a lamp compartment 91*a* and a driving-device compartment 91*b*.

A lamp assembly 95 is pivotally installed in the lamp compartment 91*a*. A vertical driving device 96 is installed in the driving-device compartment 91*b* and affixed to the middle partition 94. A horizontal driving device 97 is fixedly installed inside the support 92.

A curved rack 95*a* is provided behind the lamp assembly 95, for the vertical driving device 96 to engage and move the lamp assembly 95. In response to the driving force from the vertical driving device 96, the lamp assembly 95 tilts up and down in the lamp compartment 91*a* of the lamp housing 91, so as to provide a vertically changeable lighting angle.

A ring gear 91*c* is provided below the lamp housing 91, for the horizontal driving device 97 to engage and move the lamp assembly 95. In response to the driving force from the horizontal driving device 97, the lamp housing 91, together with the lamp assembly 95 installed in its lamp compartment 91*a*, swivels right and left against the support 92, so as to provide a horizontally changeable lighting angle.

However, the conventional spotlight 90 is structurally defective because the horizontal driving device 97 is fixed inside the support 92. In damp weather conditions, once rainwater permeate into the support 92 of the spotlight 90, the horizontal driving device 97 tends to get damaged by moisture.

SUMMARY OF THE INVENTION

In view of this, the primary objective of the present invention is to provide a moisture-proof spotlight, which improves the prior-art device by making its vertical and horizontal driving devices both installed in its lamp housing instead of the support, so that the driving devices are secured from moisture and in turn the whole spotlight is durable even in damp weather conditions.

The moisture-proof spotlight comprises a lamp housing, a support pivotally supporting the lamp housing from below, and a lamp assembly pivotally installed inside the lamp housing. The lamp housing contains therein a moisture-proof partition set, a vertical driving device, a horizontal driving device and a stationary gear.

The moisture-proof partition set includes a vertical partition and a horizontal partition. The vertical partition divides the interior of the lamp housing into a lamp compartment and a driving-device compartment, and the lamp assembly is pivotally installed in the lamp compartment of the lamp housing. The horizontal partition forms a floor of the driving-device compartment of the lamp housing.

The stationary gear is located below the horizontal partition of the moisture-proof partition set, and combined with the support as an integrated structure through a fixing member.

The vertical driving device is fixed to the vertical partition of the moisture-proof partition set, and drives the lamp assembly to tilt up and down in the lamp compartment of the lamp housing, so as to change the illuminating angle of the moisture-proof spotlight vertically.

The horizontal driving device is fixed to the horizontal partition, and drives the lamp housing and the lamp assembly to swivel right and left against the support, so as to change the illuminating angle of the moisture-proof spotlight horizontally.

The lamp housing of the moisture-proof spotlight is preferably composed of an upper half and a lower half.

As a preferred embodiment, the upper half of the lamp housing has a first slot and the lower half of the lamp housing has a second slot, in which the vertical partition has laterals thereof inlaid to and retrained by the first slot and the second slot, so that the driving-device compartment in the lamp housing is less affected by moisture in damp weather conditions.

In the disclosed moisture-proof spotlight, the vertical driving device and the horizontal driving device are both installed in the driving-device compartment of the lamp housing, and are secured from moisture, so the whole spotlight is advantageously durable.

DETAILED DESCRIPTION OF THE PREFERRED EMBODIMENT

Figure 1:
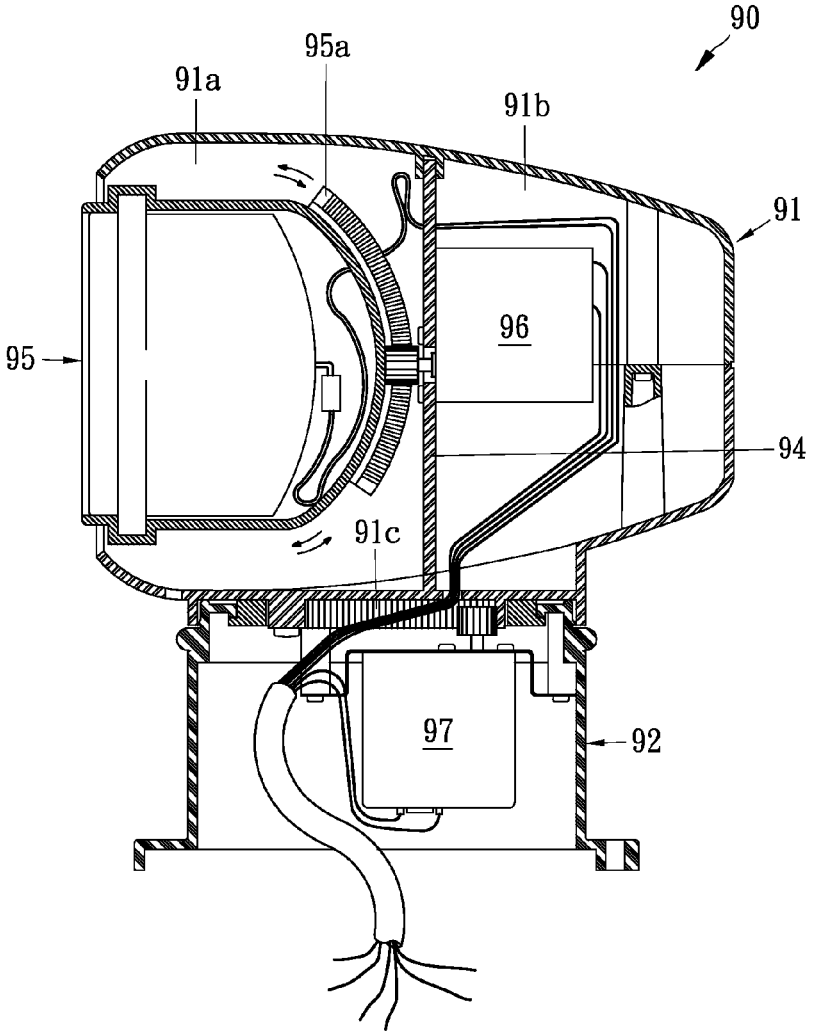
FIG. 1 (prior art)
FIG. 1 is a cross-sectional view of a conventional spotlight.
Figure 2:
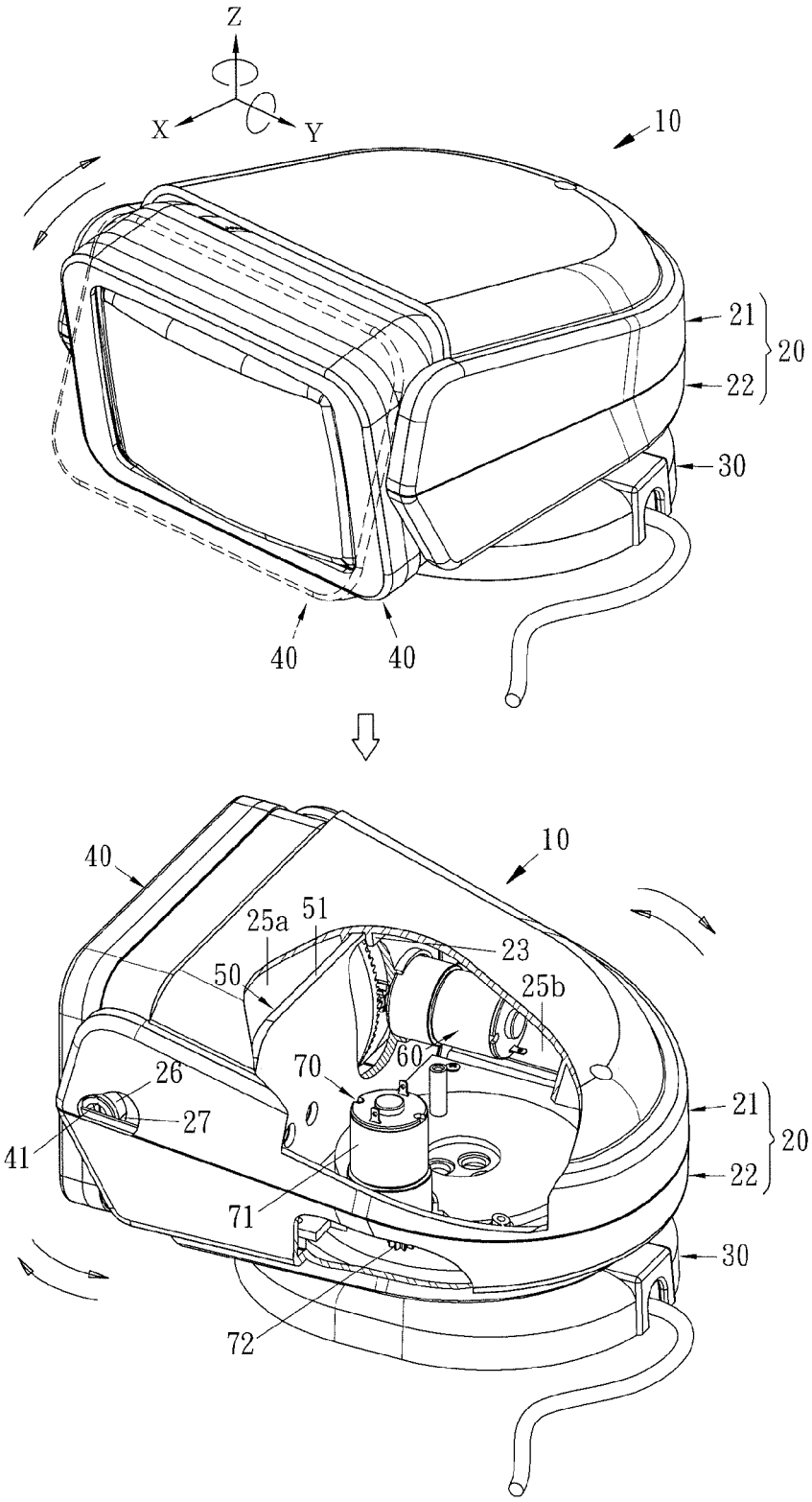
FIG. 2 provides a perspective view and a cutaway view of a moisture-proof spotlight according to the present invention.
Figure 3:
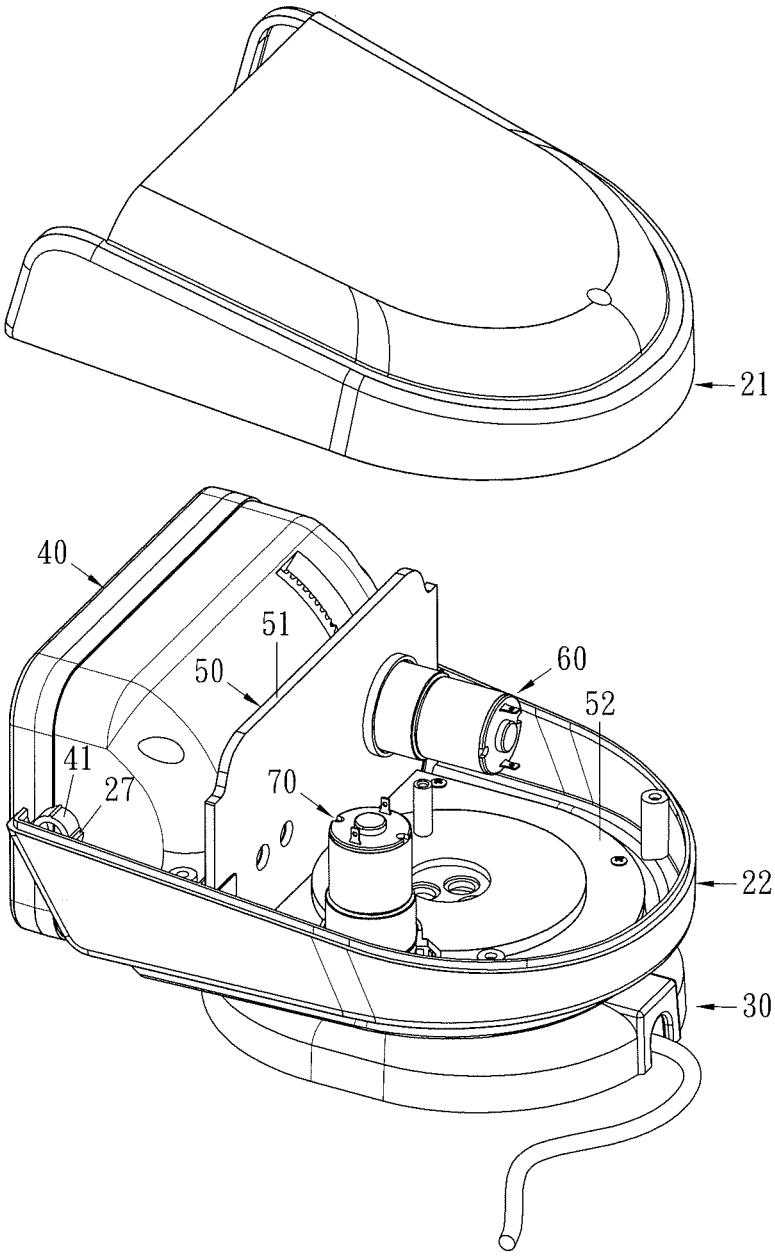
FIG. 3 shows the moisture-proof spotlight of FIG. 2 with its upper half lifted.
Figure 4:
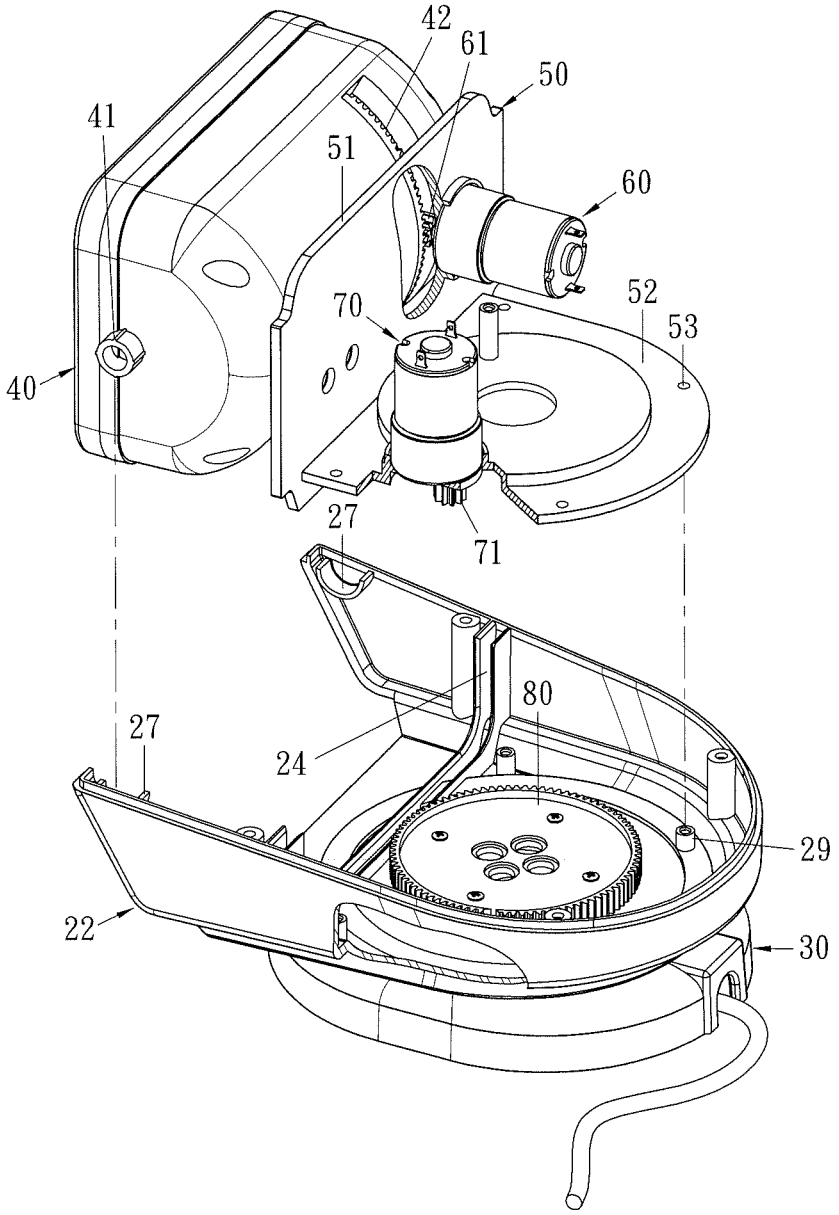
FIG. 4 depicts components of the moisture-proof spotlight that are installed in its lamp housing.
Figure 5:
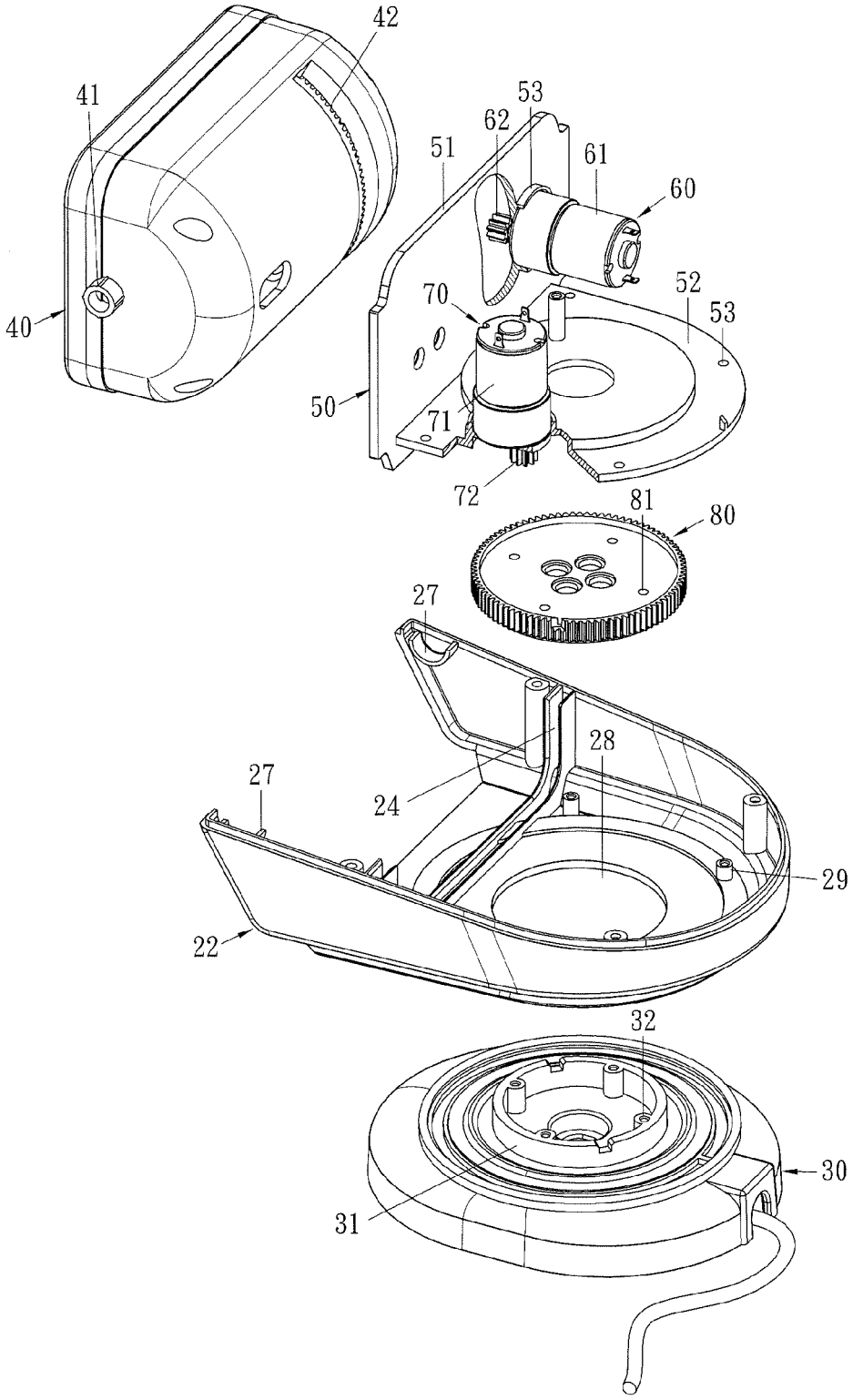
FIG. 5 is a partially exploded view of the moisture-proof spotlight with the upper half removed.

Referring to FIG. 2, the disclosed moisture-proof spotlight 10 is a versatile spotlight with its illumination changeable vertically and horizontally. The moisture-proof spotlight 10 comprises a lamp housing 20, a support 30 pivotally supporting the lamp housing 20 from below, and a lamp assembly 40 pivotally installed inside the lamp housing 20.

As shown in FIG. 2 through FIG. 5, the lamp housing 20 is composed of an upper half 21 and a lower half 22, and contains therein a lamp assembly 40, a moisture-proof partition set 50, a vertical driving device 60, a horizontal driving device 70 and a stationary gear 80.

The upper half 21 of the lamp housing 20 is provided with a first slot 23, and the lower half 22 of the lamp housing 20 is provided with a second slot 24 which is positional corresponding to the first slot 23 of the upper half 21. The lower half 22 of the lamp housing 20 is further provided with a through hole 28 and a plurality of fixing ribs 29.

The moisture-proof partition set 50 comprises a vertical partition 51 and a horizontal partition 52. When assembled, the vertical partition 51 has its four edges inlaid into and retained by the first slot 23 and the second slot 24 formed in the lamp housing 20, so that the interior of the lamp housing 20 is divided into a lamp compartment 25*a* and a driving-device compartment 25*b*. Particularly, the lamp assembly 40 is pivotally installed in the lamp compartment 25*a* of the lamp housing 20.

The horizontal partition 52 of the moisture-proof partition set 50 has a plurality of locking holes 53 that are positional corresponding to the fixing ribs 29 at the lower half 22 of the lamp housing 20. When assembled, the horizontal partition 52 is fixed to the lower half 22 of the lamp housing 20 by fixing members, while a sufficient space is left below the horizontal partition 52 for receiving the stationary gear 80. This configuration, as defined herein, refers to that the horizontal partition 52, when assembled, forms a floor of the driving-device compartment 25*b* of the lamp housing 20.

The driving-device compartment 25*b* of the lamp housing 20 is sealed by the vertical partition 51 and the horizontal partition 52 of the moisture-proof partition set 50 and obtains excellent moisture-proof effect.

The vertical driving device 60 comprises a reversible motor 61 and a pinion 62. The vertical driving device 60 is fixed to the vertical partition 51 of the moisture-proof partition set 50, and is received in the driving-device compartment 25*b* of the lamp housing 20.

The horizontal driving device 70 comprises a reversible motor 71 and a pinion 72. The horizontal driving device 70 is fixed to the horizontal partition 52 of the moisture-proof partition set 50, and is received in the driving-device compartment 25*b* of the lamp housing 20.

The lamp assembly 40 has each of its two laterals provided with a pivot 41, while a recessed rack 42 extends along a back of the lamp assembly 40.

For pivotally installing the lamp assembly 40 into the lamp compartment 25*a* of the lamp housing 20, the upper half 21 of the lamp housing 20 has upper pivot seats 26 for pivotally supporting the pivots 41 of the lamp assembly 40 jointly with lower pivot seats 27 provided correspondingly at the lower half 22 of the lamp housing 20. When the upper half 21 and the lower half 22 of the lamp housing 20 are combined, the upper pivot seats 26 of the upper half 21 and the lower pivot seats 27 of the lower half 22 jointly form two pivot seats that allow the pivots 41 of the lamp assembly 40 to be pivotally installed therein.

When the lamp assembly 40 is pivotally installed in the lamp compartment 25*a* of the lamp housing 20, the vertical driving device 60 is fixed to the vertical partition 51 of the moisture-proof partition set 50, and has its pinion 62 engaged with the recessed rack 42 of the lamp assembly 40. In response to the driving force coming from the vertical driving device 60 through the pinion 62, the lamp assembly 40 tilts up and down in the lamp compartment 25*a* of the lamp housing 20, so as to change its illuminating angle vertically.

The stationary gear 80 has a plurality of locking holes 81. The support 30 has a raised ring 31 that is provided with a plurality of fixing ribs 32 at its inner periphery. The fixing ribs 32 are positional corresponding to the locking holes 81 of the stationary gear 80, so that fixing member can pass through the locking holes 81 and fix the stationary gear 80 to the raised ring 31, making the stationary gear 80 combine with the support 30 as an integrated structure.

Referring to FIG. 2 through FIG. 5, during assembly, the raised ring 31 of the support 30 has its top pass through the through hole 28 of the lower half 22 of the lamp housing 20 and partially exposed outside the lower half 22 for the stationary gear 80 to affix.

When the horizontal partition 52 of the moisture-proof partition set 50 forms the floor of the driving-device compartment 25*b* of the lamp housing 20, the stationary gear 80 is located below the horizontal partition 52 of the moisture-proof partition set 50. The horizontal driving device 70 is fixed to the horizontal partition 52 of the moisture-proof partition set 50, and has its pinion 72 engaged with the stationary gear 80. In response to the driving force coming from the horizontal driving device 70 through the pinion 72, the lamp housing 20, together with the lamp assembly 40 installed in its lamp compartment 25*a*, swivels right and left against the support 30, so as to change its illuminating angle horizontally.

To sum up, the disclosed moisture-proof spotlight 10 features that the vertical driving device 60 and the horizontal driving device 70 are both installed inside the driving-device compartment 25*b* of the lamp housing 20, so that the driving devices are secured from moisture and in turn the whole spotlight is durable even in damp weather conditions.

What is claimed is:

1. A moisture-proof spotlight comprising a lamp housing, a support pivotally supporting the lamp housing from below, and a lamp assembly pivotally installed inside the lamp housing, wherein the improvement comprises:

the lamp housing contains therein a moisture-proof partition set, a vertical driving device, a horizontal driving device and a stationary gear;

the moisture-proof partition set comprising a vertical partition and a horizontal partition, wherein the vertical partition divides an interior of the lamp housing into a lamp compartment for the lamp assembly pivotally installed therein and a driving-device compartment having a floor formed from the horizontal partition thereof;

the stationary gear being located below the horizontal partition of the moisture-proof partition set and combined with the support as an integrated structure by means of a fixing member;

the vertical driving device being fixed to the vertical partition of the moisture-proof partition set and used for driving the lamp assembly to tilt up and down in the lamp compartment of the lamp housing; and the horizontal driving device being fixed to the horizontal partition of the moisture-proof partition set and used for driving the lamp housing and the lamp assembly to swivel right and left against the support.

2. The moisture-proof spotlight of claim 1, wherein the lamp housing is constructed from an upper half and a lower half.

3. The moisture-proof spotlight of claim 2, wherein the upper half has a first slot and the lower half has a second slot, and wherein the vertical partition of the moisture-proof partition set has laterals thereof inlaid to and retrained by the first slot and the second slot.

* * * * *